United States Patent [19]

Sowersby

[11] Patent Number: 4,840,411

[45] Date of Patent: Jun. 20, 1989

[54] ELECTROMAGNETIC SHEAR LOCK

[75] Inventor: Alan C. Sowersby, Wallingford, Conn.

[73] Assignee: Harrow Products, Inc., Wallingford, Conn.

[21] Appl. No.: 14,831

[22] Filed: Feb. 13, 1987

[51] Int. Cl.[4] ..... E05C 17/16

[52] U.S. Cl. ..... 292/251.5; 335/261; 292/144

[58] Field of Search ..... 292/251.5, 201, 144; 403/DIG. 1; 335/261, 281, 279

[56] References Cited

U.S. PATENT DOCUMENTS

| | | | |
|---|---|---|---|
| 2,497,697 | 2/1950 | Smith | 292/251.5 |
| 2,673,755 | 3/1954 | Asp | 292/251.5 |
| 2,719,050 | 9/1955 | Teetor | 292/251.5 |
| 3,204,154 | 8/1965 | Crandell | 292/251.5 |
| 3,533,652 | 10/1970 | Crane et al. | 292/251.5 |
| 3,537,719 | 11/1970 | Gottfried | 403/DIG. 1 |
| 3,993,972 | 11/1976 | Barbrook | 335/281 |
| 4,439,808 | 3/1984 | Gillham | 292/144 |
| 4,439,808 | 3/1984 | Gillham | 292/144 |
| 4,487,439 | 12/1984 | McFadden | 292/251.5 |
| 4,491,816 | 1/1985 | Blum | 335/245 |
| 4,562,665 | 1/1986 | Blackston | 292/144 |
| 4,652,028 | 3/1987 | Logan et al. | 292/251.5 |
| 4,682,801 | 7/1987 | Cook et al. | 292/251.5 |
| 4,688,012 | 8/1987 | Bong et al. | 335/281 |
| 4,716,393 | 12/1987 | Logie | 335/281 |
| 4,720,128 | 1/1988 | Logan, Jr. et al. | 292/251.5 |

FOREIGN PATENT DOCUMENTS

| | | | |
|---|---|---|---|
| 226753 | 7/1958 | Australia | 292/251.5 |
| 1194528 | 11/1959 | France | 292/251.5 |
| 351186 | 2/1961 | Switzerland | 292/251.5 |
| 1530591 | 11/1978 | United Kingdom | 292/251.5 |
| 2095321 | 9/1982 | United Kingdom | 292/251.5 |

*Primary Examiner*—Gary L. Smith
*Assistant Examiner*—Eric K. Nicholson
*Attorney, Agent, or Firm*—Robert H Montgomery

[57] ABSTRACT

An electromagnetic shear lock comprising an electromagnewt having an E-shaped cross section with a coil positioned about the middle leg of the E is mounted in a doorway and an armature having a central projection is mounted to the door, where the middle leg of the E is shortened to define a recess to receive the armature projection and provide mechanical reinforcement against shearing when the electromagnet is energized. The inner edges of the outer legs of the E and the edges of the armature projection are matingly beveled to prevent binding when the electromagnet is de-energized and an airgap is defined between the middle leg of the E and the armature projection to overcome any effects of residual magnetism.

7 Claims, 2 Drawing Sheets

ELECTROMAGNETIC SHEAR LOCK

FIELD OF THE INVENTION

This invention relates to magnetic door locks, and more particularly, to magnetic door locks of the type known as shear locks.

BACKGROUND OF THE INVENTION

Electromagnetic security locks are well known in which an electromagnet is mounted to one of a door frame or a door and an armature is mounted to the other. In the predominant installations of such locks, the armature and electromagnet are generally mounted so that the face of the electromagnet and armature is parallel with a plane of the door and the holding force or attractions between the electromagnet and armature is perpendicular to the door when in a closed position. Any attempted forced opening of the door is resisted by the electromagnetic attraction of the armature to the electromagnet.

This type of arrangement is very effective, providing a locking force against unauthorized opening of a door. However, as is generally the case, the armature must be mounted on the vertical surface of the door, while the electromagnet is mounted from the door frame and overhangs the top edge of the door. This type of lock, while very effective from a security standpoint, is not suitable for mounting on many types of swinging or double-acting doors.

Also, in many instances, for aesthetic purposes, a better concealment of the electromagnetic lock is desirable. This has led to increased popularity of the so-called magnetic shear lock, in which the electromagnet is mounted within the door frame and an armature is mounted at or adjacent the top edge of the door and is adapted to be attracted to the electromagnet when the door is in a closed position.

This type of magnetic shear lock presents some technical problems which must be considered. When such a magnetic shear lock is mounted to a door and frame such that the electromagnet will exert an upward pull on the armature to achieve locking of the door, there must be some mechanical locking effort because the full magnetic attraction of the armature to the electromagnet is not available as a holding force when attempt is made to produce shearing movement between the armature and the electromagnet.

This problem has been recognized in U.S. Pat. No. 4,562,665, which discloses an armature mounted in the door which has two projections with vertical side walls which fit into two mating recesses in the electromagnet. Thus, when the armature is attracted to the electromagnet, the projections extend into the recesses and provide a mechanical lock. This type of construction does not take into account the possible effects of residual magnetism in the electromagnet when it may be deenergized to permit opening of the door, particularly if an opening force is applied to the door at the same time the electromagnet is deenergized. Specifically, if there is an attempt being made to open the door when the electromagnet is deenergized, the residual magnetism may still provide attraction between the armature and the electromagnet, and the vertical surfaces of the projections in the recesses will prevent opening of the door.

This problem appears to have been recognized in U.S. Pat. No. 4,487,439 in which a non-magnetic projection is placed in one of the armature and the electromagnet, and a recess placed in the other, and a beveled edge is defined on the projection to enable the armature to be pushed away from the electromagnet by a force attempting to open the door when the electromagnet is deenergized. In this construction, the projection has a matching circular indentation or recess somewhat larger in diameter than the projection. However, this type of construction suffers from a drawback in that when an attempt is made for unauthorized opening of the door, the circular pin or projection only makes a point contact with the recess in the armature, and this will very quickly show signs of wear after attempts to force the lock by applying shear force.

The problem of the residual magnetism in an electromagnetic shear lock which includes a mechanical reinforcing structure of the electromagnet when energized is discussed in U.S. Pat. No. 4,439,808. In the construction disclosed in this patent, a magnetic flux cancelling circuit is provided to overcome the residual magnetism in the electromagnet when the electromagnet is switched off.

Accordingly, the present invention provides a new and improved magnetic shear lock having mechanical holding means when the electromagnet is energized, which is so constructed that the effects of residual magnetism will not prevent opening of the door when the electromagnet is deenergized while an opening force is applied to the door.

SUMMARY OF THE INVENTION

Briefly stated, the invention in one form thereof comprises an electromagnet having an E-shaped cross section adapted to be mounted in the frame or soffit of a door and an armature which is mounted with its face at the top or bottom edge of the door. The armature is constructed and arranged for vertical movement for attraction to the electromagnet, and to drop away therefrom under the force of gravity in the top mounted position, when the energization of the electromagnet is removed. The electromagnet is formed with a longitudinal recess along its length, with beveled edges defining the sides of the longitudinal recess. The armature is shaped with a projection having mating beveled edges which will extend into the recess of the electromagnet. The recess in the electromagnet is defined by making the middle leg of the E-shaped core shorter than the outer legs. The outer legs of the E-shaped electromagnet will contact the armature while an airgap is defined between the middle leg of the E-shaped electromagnet and the projection on the armature. Clearance is defined between the beveled side edges of the projection on the armature and the outer legs of the electromagnet. Thus, when the electromagnet is deenergized, an airgap will provide a high reluctance path to any residual magnetism attempting to attract the armature to the electromagnet. Additionally, the beveled edges will provide the force tending to depress the armature when a shearing force is between the electromagnet and the armature after the electromagnet has been deenergized. However, the mating beveled edges between the electromagnet and recess and the armature projection provide a mechanical holding force against shearing motion of the armature with respect to the electromagnet when the electromagnet is energized.

An object of this invention is to provide a new and improved electrically actuated magnetic lock of the shear type for use between a door and a door frame.

A further object of this invention is to provide a new and improved construction for an electromagnetic shear lock of the type described in which the effects of residual magnetism in the electromagnet may be overcome when the electromagnet is deenergized and a force is applied to attempt to open the door.

The features of the invention which are believed to be novel are particularly pointed out and distinctly claimed in the concluding portion of the specification. The invention, however, together with further objects and advantages thereof, may best be appreciated by reference to the following detailed description taken in conjunction with the drawings.

DESCRIPTION OF PREFERRED EMBODIMENTS OF THE INVENTION

Figure 1:
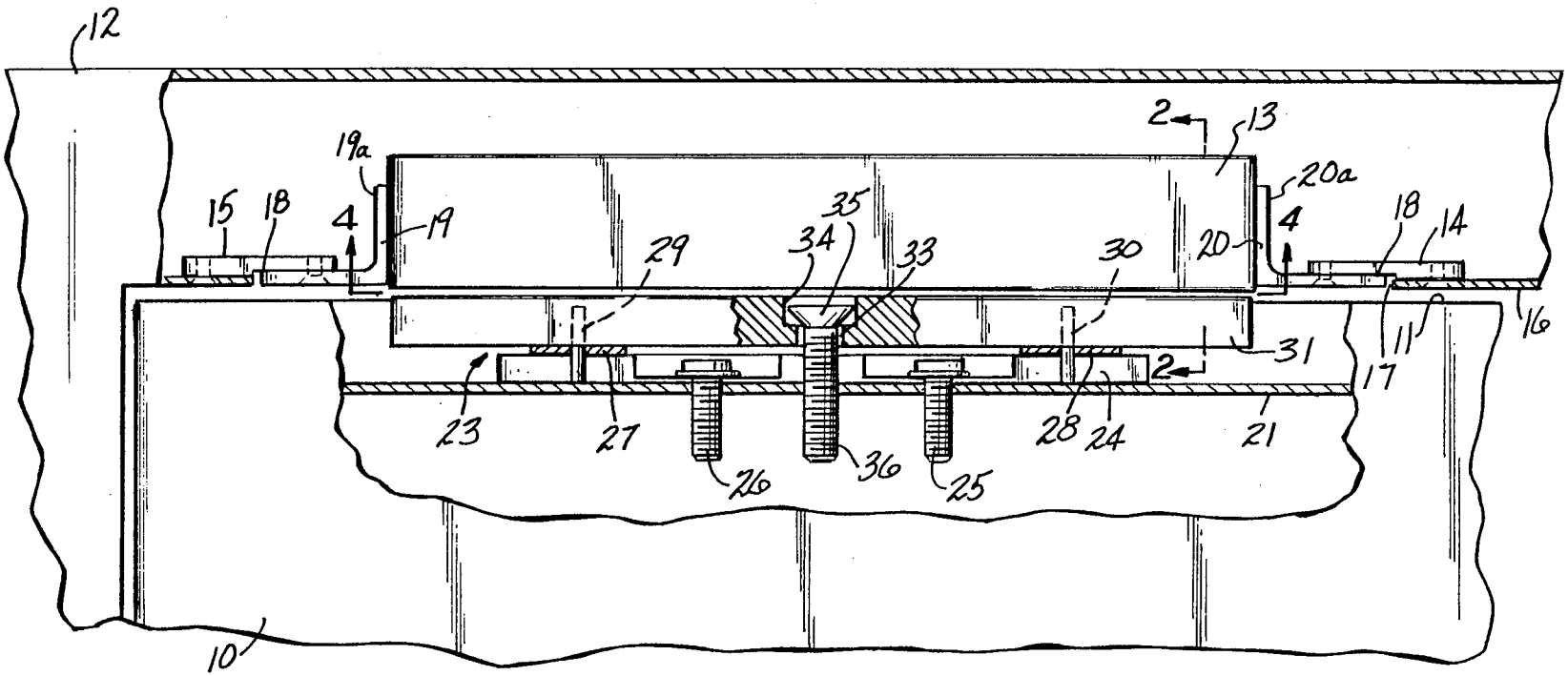
FIG. 1 is a front elevation of a portion of a door and door frame partially cut away to show the installation of a magnetic shear lock embodying the invention.

FIG. 1 exemplifies a door 10 closing a doorway 11 which is defined by a door frame 12. The door 10, as shown, will be hinged on the right side.

In FIG. 1, the door frame 12 is shown as being of a hollow metal configuration and a portion is removed therefrom to permit insertion of an electromagnet 13. When a portion of the door frame has been removed to define an opening into the hollow interior, mounting plates 14 and 15 are affixed to the soffit 16 of the doorway as by means of screws or bolts. The mounting plates 14 and 15 extend over the defined opening 17 in the door frame and are recessed on the bottom at 18.

Non-magnetic L-shaped support members 19 and 20 are secured to the recess portions 18, mounting plates 14 and 15 and provide upright arms **19*a* and 20*a* which receive electromagnet 13 therebetween. The electromagnet is secured to the upright arms 19*a* and 20*a*** by a plurality of screws (not shown).

Electromagnet 13 is generally of E-shaped cross section, as hereinafter described. The door 10 which is generally of a hollow metal structure, either has a stiffening member 21 therein or one is provided to support the armature. The armature assembly comprises an armature mounting plate 24 which is secured to member 21 by bolts 25 and 26. The bolts 25 and 26 pass through recessed slotted openings in mounting plate 24 so that the heads thereof are below the top surface of mounting plate 24. Armature mounting plate 24 defines two elongated slots 27 and 28 which receive pins, respectively, carried in armature 31. The pins 29 and 30 prevent the armature from rotational movement about its center.

Armature 31 has an opening 33 which is countersunk as shown at 34. The head 35 of a bolt 36 is received in the countersink. Bolt 36 is threaded into member 21 and armature mounting plate 24. The bolt 33 mounts armature 31 to armature mounting plate 24, but permits vertical movement of armature 31.

Figure 2:
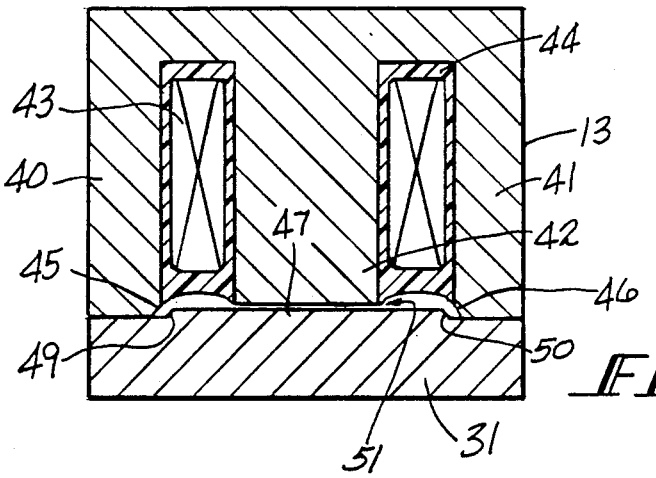
FIG. 2 is a view seen in the plane of lines 2—2 of FIG. 1 when the electromagnet is energized.
Figure 3:
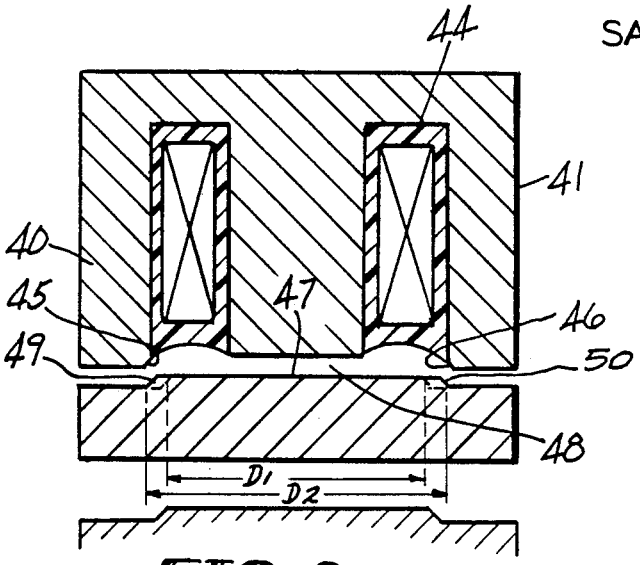
FIG. 3 is a view similar to FIG. 2 seen in the plane of lines 2—2 of FIG. 1 when the electromagnet is not energized.
Figure 4:
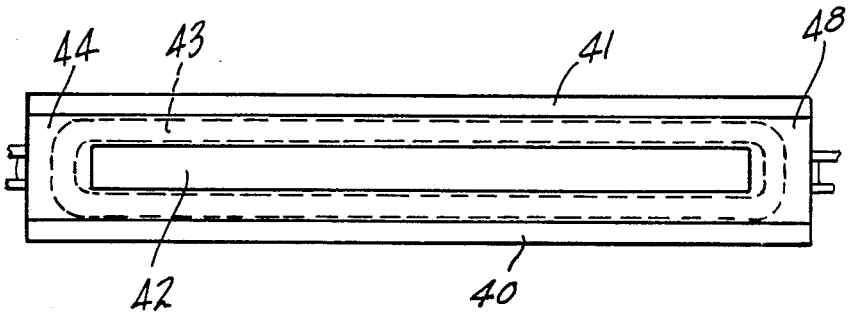
FIG. 4 is a view seen in the plane of lines 4—4 of FIG. 1, reduced in size.

FIG. 2 illustrates electromagnet 13 in cross section. As previously mentioned, electromagnet 13 is E-shaped in cross section, having equal outer legs 40 and 41, and a shorter inner leg 42. A preformed coil 43 as shown in FIG. 4 is placed between the legs 40 and 41 about leg 42 and encapsulated therein with a suitable potting compound 44. The inner sides of legs 40 and 41 are beveled as shown at 45 and 46, respectively.

Armature 31 has an elongated projection 47 on the upper surface thereof, which extends into an elongated recess 48 defined by the shorter middle leg 42.

Projection 47 is beveled along the edges 49 and 50 thereof on a substantially mating angle with the bevels 45 and 46 on legs 40 and 41, respectively.

When the electromagnet is energized and the armature 31 is attracted thereto, as shown in FIG. 2, projection 47 extends into recess 48 and provides for area contact of projection 47 at the bevels 45 and 46 on legs 40 and 41. This area contact extends on both sides of projection 47 the entire length of the armature. This provides great mechanical reinforcement against shearing movement of the armature with respect to the electromagnet in either direction of an attempt to open the swinging type door.

This contact does not occur at all times since the width dimension D1 of projection 47 is less than the width dimension D2 of recess 48. The contact occurs only when an attempt to force the door is made and the force exerted is sufficient to otherwise shear the magnetic holding force. The armature may slide a short distance until one of its bevels 49 or 50 makes area contact with a corresponding one of bevels 45 or 46 on electromagnet 13.

The beveled edges are provided so that the projection 47 will not bind if an attempt is made to open the door while the electromagnet is energized and the magnet is then deenergized, as might the case if the bevels were not provided and the edges of the projection 47 were perpendicular.

It has been determined that a bevel of approximately fifteen degrees from the vertical is acceptable. If the bevel decreases below ten degrees, then the aforementioned binding might occur. If the bevel increases above thirty-five degrees, then there may be a loss of the mechanical reinforcing strength inasmuch as a very strong person might be able to shear the magnetic attraction of the armature to the electromagnet.

Figure 5:
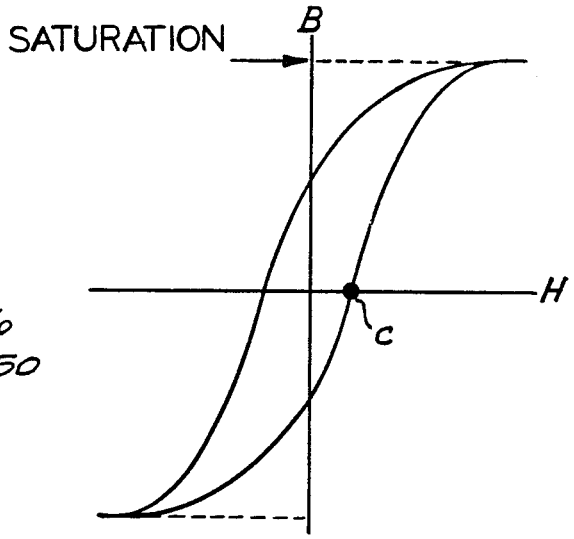
FIG. 5 is a representation of a hysteresis loop.

The provision of an airgap 51 acts to prevent the magnetic material from being driven into saturation. The residual magnetism left in a material after an imposed saturating magnetic field has been removed is known as coercivity, as represented in FIG. 5 by the intercept of the H axis when the flux density B is zero. FIG. 5 is a representation of a hysteresis loop showing magnetizing force H as a function of flux density B in magnetic material. The point C represents the residual magnetism at zero flux density. Thus the airgap 51 is provided as a means to prevent saturation of the armature and thus reduce any residual magnetism that otherwise might be present in the absence of the airgap. It has been determined that in a magnet designed for the purpose disclosed, an airgap 51 of 0.002 inches overcomes residual magnetism. The airgap should not be substantially more than 0.002 inches; otherwise the magnetic holding force will be decreased. With this airgap 51, it has been determined that there is no residual magnetism producing a sticking effect of the armature on the electromagnet, when the electromagnet is deenergized.

An electromagnetic shear lock as described may also be arranged for bottom mounting. In such case, the electromagnet is mortised mounted, concealed within a threshold plate, and the armature is concealed in the bottom door rail. In this type of mounting, the armature will be biased upwardly by springs (not shown) extending between the upper support plate and the lower armature. Otherwise the construction is the same as shown in FIGS. 1–4.

It must be seen that the objects of the invention set forth, as well as those made apparent from the foregoing description, are efficiently attained. While preferred embodiments of the invention have been set forth for purposes of disclosure, modifications to the disclosed embodiments of the invention, as well as other embodiments thereof, may occur to those skilled in the art. Accordingly, the appended claims are intended to cover all embodiments of the invention and modifications to the disclosed embodiments which do not depart from the spirit and scope of the invention.

Having thus described the invention, what is claimed is:

1. A magnetic shear lock of the type comprising one of an electromagnet and an armature for locking a door to a door opening where the door opening is defined by a frame and the door is vertically hinged to said frame for horizontal swinging motion, an electromagnet mounted in the door opening, said electromagnet comprising an E-shaped core having two outer legs and an intermediate leg, all of said legs extending vertically from a common base, an energizing coil wound about said intermediate leg between said outer legs, an armature member adapted to be mounted in the door for vertical movement toward said electromagnet when said coil is energized, said armature having a central elongated longitudinal projection on its surface facing said electromagnet and integral with said armature, the edges of said projection being inwardly beveled ten to thirty-five degrees, the outer legs of said electromagnet having surfaces arranged to make surface contact with said armature on either side of said projection when said coil is energized, said outer legs of said electromagnet having outwardly beveled edges on the inner sides thereof of ten to thirty-five degrees arranged to make contact with the beveled edges of said armature projection, said intermediate leg of said electromagnet being of lesser dimension than said outer legs to define a recess between said outer legs for said armature projection, said projection of said armature being received between said outer legs of said electromagnet when said coil is energized and providing a mechanical resistance to shearing movement between said electromagnet and said armature when said coil is energized.

2. The magnetic shear lock of claim 1 in which an airgap of at least 0.002 inches is defined between said intermediate leg of said electromagnet and said armature projection when said armature is attracted to said electromagnet.

3. The magnetic shear lock of claim 1 where said bevels on said electromagnet and said armature projection are approximately fifteen degrees.

4. A magnetic shear lock of the type comprising an electromagnet and an armature for locking a door to a door opening where the door opening is defined by a frame and the door is vertically hinged to said frame for horizontal swinging motion, an electromagnet mounted in the door opening, said electromagnet comprising an E-shaped core having two outer legs and an intermediate leg, all of said legs extending vertically from a common base, an energizing coil wound about said intermediate leg between said outer legs, an armature member adapted to be mounted in the door for vertical movement toward said electromagnet when said coil is energized, said armature having a Central elongated longitudinal projection on its surface facing said electromagnet and integral with said armature, the edges of said projection being inwardly beveled, the outer legs of said electromagnet having surfaces arranged to make surface contact with said armature on either side of said projection when said coil is energized, said outer legs of said electromagnet having outwardly beveled edges on the inner sides thereof arranged to mate with the beveled edges of said armature projection, said intermediate leg of said electromagnet being of lesser dimension than said outer legs to define a recess between said outer legs so that when said armature is attracted to said electromagnet there is a small airgap between said intermediate leg and said armature projection, said projection of said armature being received between said outer legs of said electromagnet when said coil is energized and providing a mechanical resistance to shearing movement between said electromagnet and said armature when said coil is energized.

5. The magnetic shear lock of claim 4 where the airgap between said intermediate leg and said armature projection is at least 0.002 inches when said armature is attracted to said electromagnet.

6. The magnetic shear lock of claim 5 where the angle of bevel on said armature projection and on said outside legs is ten to thirty-five degrees.

7. The magnetic shear lock of claim 6 where the angles of bevel on said projection and said outer legs is approximately fifteen degrees.

* * * * *